US007344810B2

(12) United States Patent
Ito et al.

(10) Patent No.: US 7,344,810 B2
(45) Date of Patent: Mar. 18, 2008

(54) PHOTOSENSITIVE MEMBER

(75) Inventors: Kimiyiki Ito, Kawanishi (JP); Keiichi Inagaki, Itami (JP); Takeshi Ishida, Nara (JP)

(73) Assignee: Minolta Co., Ltd., Osaka (JP)

( * ) Notice: Subject to any disclaimer, the term of this patent is extended or adjusted under 35 U.S.C. 154(b) by 1051 days.

(21) Appl. No.: 09/955,030

(22) Filed: Sep. 19, 2001

(65) Prior Publication Data

US 2002/0048711 A1 Apr. 25, 2002

Related U.S. Application Data

(62) Division of application No. 08/693,717, filed on Aug. 7, 1996, now abandoned.

(30) Foreign Application Priority Data

Aug. 9, 1995 (JP) ..... H 7-203086
Aug. 9, 1995 (JP) ..... H 7-203087

(51) Int. Cl.
*G03G 5/147* (2006.01)

(52) U.S. Cl. ..... 430/66; 430/67; 430/65; 430/60

(58) Field of Classification Search ..... 430/66, 430/67

See application file for complete search history.

(56) References Cited

U.S. PATENT DOCUMENTS 4,416,963 A 11/1983 Takimoto et al. ..... 430/63
4,687,723 A 8/1987 Ohshima et al.
5,008,172 A * 4/1991 Rokutanzono et al. ..... 430/66
5,320,922 A 6/1994 Mayama et al. ..... 430/63
5,385,797 A 1/1995 Nagahara et al.
5,391,446 A 2/1995 Ohtani et al.
5,391,449 A 2/1995 Maruyama et al.
5,422,210 A 6/1995 Maruyama et al.
5,455,135 A 10/1995 Maruyama et al.
5,484,694 A 1/1996 Lelental et al. ..... 430/63
5,571,456 A 11/1996 Bergmann et al. ..... 252/518

FOREIGN PATENT DOCUMENTS

JP 56-138742 10/1981
JP 60-144755 7/1985

OTHER PUBLICATIONS

Borsenberger, Paul M. et al. Organic Photoreceptors for Imaging Systems. Marcel-Dekker, Inc. (1993) pp. 25-35 & 289-296.*

* cited by examiner

*Primary Examiner*—Christopher RoDee
(74) *Attorney, Agent, or Firm*—McDermott Will & Emery LLP

(57) ABSTRACT

The invention relates to an electrophotographic photosensitive member, and more specifically, to a photosensitive member having a photosensitive layer superimposed over a substrate. In one aspect of the invention, sequential laminations of a dispersion layer of conductive tantalum-doped tin oxide powder dispersed in a binder resin solution, are provided between the substrate layer and the photosensitive layer. Another aspect of the invention relates to a protective layer provided for the photosensitive layer. The protective layer of the most exterior surface of the photosensitive member may be a dispersion layer formed by dispersing tantalum-doped tin oxide powder in a resin solution.

17 Claims, 1 Drawing Sheet

PHOTOSENSITIVE MEMBER

This application is a divisional of application Ser. No. 08/693,717 filed Aug. 7, 1996 now abandoned.

BACKGROUND OF THE INVENTION

The present invention relates to an electrophotographic photosensitive member, and more specifically, to a photosensitive member comprising a dispersion layer and a photosensitive layer sequentially superimposed over a substrate.

One aspect of the present invention relates to an intermediate layer provided between a substrate layer and a photosensitive layer.

Another aspect of the present invention relates to a protective layer provided for a photosensitive layer.

Electrophotographic photosensitive members are generally formed by providing a photosensitive layer over an electrically conductive substrate such as aluminum or the like. When a photosensitive member is constructed by forming a photosensitive layer directly over a conductive substrate, however, unnecessary charge is readily injected from the substrate so as to easily produce noise in the formed image. This charge injection is believed to be caused by a general irregularity of the surface of the conductive substrate made of aluminum or the like. As a result of surface irregularities, a concentration of charge easily occurs at the surface convexities or protrusions so as to cause a breakdown of said convexities. Therefore, for example, in the case of positive developing, the electrostatic latent image required for image formation on the photosensitive member is erased by the injection of unnecessary charge from the substrate. A toner image is not formed in these areas regardless of whether or not these areas are supposed to form the toner image. This results in so-called white spots and image noise. As a further example, in the case of reverse developing, the toner image is conversely formed in areas in which image formation is not supposed to form or occur. This results in so-called black spots and image noise.

An intermediate layer can be formed between the conductive substrate and the photosensitive layer to prevent the injection of unnecessary charge from said conductive substrate.

When such an intermediate layer is formed as an insulation layer, comprising a single resin having a high electrical resistance, a smooth flow of charge from the substrate to the photosensitive layer is impeded. This leads to a separate disadvantage, wherein following optical exposure, the surface potential of the photosensitive member is not reduced to a predetermined value, thereby resulting in an elevation of the residual potential.

Although the electrical resistance can be reduced by making the insulation layer extremely thin in order to eliminate the aforesaid problem, another problem is encountered. In particular, when the layer thickness is made too thin, the defects and irregularities of the conductive substrate surface are not adequately covered, and the function of the insulation layer as an intermediate layer is not sufficiently realized. Furthermore, various types of conductive additives can be included within the insulation layer. For example, Japanese Unexamined Patent Application No. SHO 60144755 discloses a resin dispersion layer containing antimony-doped tin oxide as conductive powder dispersed in resin.

In conjunction with the diversification of electrophotographic apparatuses in recent years, it has become desirable to provide photosensitive members for backside exposure, or belt-like photosensitive members. In connection with such photosensitive members, the use of a conductive intermediate layer formed on a nonconductive substrate of resin film or glass or the like, as a conductive substrate is being investigated.

Relative to another aspect of the present invention, the surface of a photosensitive layer, and particularly the surface of a photosensitive layer of an organic type photosensitive layer, is generally provided with a protective overcoat layer over the photosensitive layer to prevent injury to said photosensitive layer and improve durability. Photosensitive members are repeatedly subjected to charging and image exposure. Therefore, a protective overcoat layer requires low insularization to prevent an accumulation of charge in the interior portion or surface of the protective overcoat layer. When the electrical conductivity is excessively high, charge migration occurs in a horizontal direction and causes the production of unsharp images. Conversely, when conductivity is too low, charge accumulates and causes image fogging. Therefore, the conductivity of the protective overcoat layer must be controlled to a suitable value, and said conductivity must remain stable in the presence of external influences such as temperature and humidity and the like.

The protective overcoat layer must satisfy mechanical strength requirements so as to prevent injury from a toner cleaning blade or the like.

A protective overcoat layer may be colored by material added for low insularization insofar as such material does not produce undesirable affects on spectral sensitivity of the photosensitive member.

From this perspective, a layer having conductive particles dispersed in a binder resin can be used as a protective overcoat layer. Japanese Unexamined Patent Application No. SHO 56138742, for example, discloses a protective overcoat layer comprising a tantalum-doped tin oxide powder as electrically conductive particles dispersed in resin.

SUMMARY OF THE INVENTION

An object of the present invention is to utilize the aforesaid information to provide a novel layer containing conductive tantalum doped tin oxide powder, which is nontoxic and possesses excellent stability as a layer formed between a substrate and a photosensitive layer of a photosensitive member and/or as a protective layer for a photosensitive layer of a photosensitive member.

Another object of the present invention is to provide a photosensitive member with excellent initial surface potential characteristics and that does not produce an elevation of residual potential, or image noise such as black spots or white spots, by providing said novel layer between a photosensitive layer and a substrate.

Still another object of the present invention is to provide a photosensitive member with safe and stable electrostatic characteristics and that provides usable conductivity as a substrate of a photosensitive member by forming said novel layer on a nonconductive substrate.

The present invention relates to a photosensitive member comprising a substrate over which are provided sequential laminations of a dispersion layer of tantalum-doped tin oxide powder dispersed in resin, and a photosensitive layer.

This dispersion layer is a novel dispersion layer comprising tantalum-doped tin oxide powder dispersed in a binder resin solution.

The present invention can provide a photosensitive member having excellent stability and nontoxicity, and that inhibits the occurrence of image noise while maintaining a desired chargeability by providing said dispersion layer.

Another object of the present invention is to provide a novel layer comprising tantalum-doped tin oxide powder having excellent stability and nontoxicity as conductive particles dispersed in resin as a protective overcoat layer for a photosensitive member.

A further object of the present invention is to provide a photosensitive member with excellent photosensitive member characteristics such as photosensitivity and the like, which is capable of forming superior images without fogging or producing unsharp images, and which has excellent repetition characteristics and durability.

Thus, the present invention also relates to a photosensitive member with a protective overcoat layer comprising a dispersion layer containing tantalum-doped tin oxide powder dispersed in resin.

The invention itself, together with further objects and attendant advantages, will best be understood by reference to the following detailed description, taken in conjunction with the accompanying figures.

DETAILED DESCRIPTION OF THE INVENTION

Figure 1:
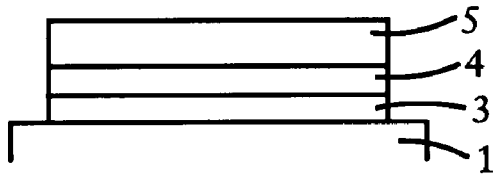
FIG. 1 is a section view of a photosensitive member according to a first embodiment of the present invention.

Dispersion Layer Between Substrate and Photosensitive Layer

In the present invention, it is possible to construct a thick dispersion layer without elevating the residual potential, and the volume resistivity of the dispersion layer can be reduced compared to constructions of a simple resin layer by a dispersion layer providing conductive tantalum-doped tin oxide powder in a dispersion layer. Even when the substrate surface has irregularities or defects because the surface has not been through a machining process, the substrate can be given a smooth finish by covering surface irregularities and defects present in the dispersion layer, so as to suppress the occurrence of image noise such as black spots and white spots caused by injection of unnecessary charge from the substrate irregularities and defects to the photosensitive layer.

The tantalum-doped tin oxide (SnO2) used in the present invention is a tin oxide doped with about 0.1 to about 10 percent-by-weight tantalum metal. The doping may be accomplished by forming a solid solution of tin oxide and tantalum, or coating the surface of the tin oxide with tantalum. Doping may also be accomplished by fusing the tantalum to the tin oxide.

The tantalum-doped tin oxide used has a mean particle size of less than about 2 μm, and preferably about 0.01 to about 1.2 μm, and ideally about 0.3 to about 1.0 μm. When the particle size is too large, dispersability in the layer is adversely affected, and the dispersion layer cannot be formed smoothly.

The content of tantalum-doped tin oxide in the dispersion layer is about 5 to about 70 percent-by-weight of the total dispersion layer. When the content is too small, the volume resistivity of the dispersion layer is not sufficiently reduced, leading to residual potential elevation and reduced photosensitivity. When the content is too large, the dispersion layer is not uniformly formed, causing image defects. Furthermore, adhesion characteristics deteriorate, and strength is lost as the layer becomes brittle. In backside exposure type photosensitive members, the desired transmittancy cannot be obtained.

In the present invention, the photosensitive member comprises a dispersion layer of tantalum-doped tin oxide powder dispersed in resin, and a photosensitive layer, said layers being laminated on a substrate. The physical properties, and particularly the volume resistivity of the dispersion layer, differ depending on the construction of the photosensitive member.

The dispersion layer is divided into an undercoat layer and a conductive layer, ditinquished by volume resistivity values. The layer having a volume resistivity of about $1\times10^{6}$ to about $1\times10^{14}$ Ω·cm, and preferably about $1\times10^{8}$ to about $1\times10^{12}$ Ω·cm, is designated the undercoat layer. The layer having a volume resistivity less than about $1\times10^{6}$ Ω·cm is designated the conductive layer. The volume resistivity of the dispersion layer is dependent on: the type of binder resin used to construct the dispersion layer, the particle size of the tine oxide powder, the amount of tantalum dope applied to the tine oxide, and the amount of tantalum-doped tin oxide powder content. Therefore, although the volume resistivity value cannot be regulated only by the amount of tantalum-doped tin oxide powder content, it is possible to achieve the function of the undercoat layer within the aforesaid content range in the dispersion layer by having a tantalum-doped tin oxide powder content less than about 40 percent by-weight. The function of the conductive layer can be achieved by having the tantalum-doped tin oxide powder content of about 30 percent-by-weight or more.

In the present invention, after the tin oxide is doped with tantalum, a silane coupling agent or titanium coupling agent is used for surface processing for even more improvement of the dispersability of the application fluid so as to form a uniform application layer. Moisture resistance is also improved more by the coupling process.

Examples of the form of the photosensitive member of the present invention described above are shown in FIGS. 1 through 3.

FIG. 1 shows a photosensitive member formed by forming an undercoat layer 3 on a substrate, then sequentially superimposing thereon a charge generating layer 4 and charge transporting layer 5 as a photosensitive layer.

Figure 2:
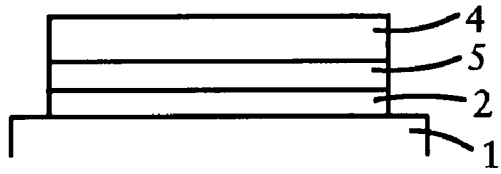
FIG. 2 is a section view of a photosensitive member according to a second embodiment of the present invention.

FIG. 2 shows a photosensitive member formed by forming a conductive layer 2 as a dispersion layer on a substrate, and sequentially superimposing thereon charge transporting layer 5 and charge generating layer 4 as a photosensitive layer.

Figure 3:
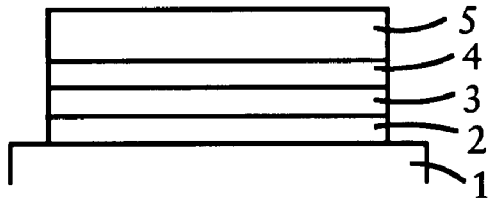
FIG. 3 is a section view of a photosensitive member according to a third embodiment of the present invention.

FIG. 3 shows a photosensitive member formed by forming a conductive layer 2 and an undercoat layer 3 as a dispersion layer on a substrate, and sequentially superimposing thereon a charge generating layer 4 and charge transporting layer 5 as a photosensitive layer. In the embodiment shown in FIG. 3, at least one among the conductive layer or the undercoat layer may be the dispersion layer according to the present invention.

Since the photosensitive member of the present invention may be obtained in various forms as previously described, the present invention is not limited to the use of a conductive substrate. For example, it is possible to use a non-conductive substrate as the substrate of the photosensitive member, as described hereinafter.

In the embodiment using a dispersion layer as an undercoat layer (e.g., see FIG. 1), it is possible to reduce the volume resistivity of the undercoat layer compared to a construction of a simple resin, so as to suppress the elevation of the residual potential. Even when surface defects and irregularities in the substrate surface are present due to non-machining or the like, such surface irregularities and some defects are covered by a thick dispersion layer, which provides a smooth finish to the substrate, and suppresses the generation of image noise by preventing the injection of unnecessary charge from said substrate irregularities and defects to the photosensitive layer. Furthermore, when a substrate containing different types of metals (e.g., aluminum alloy) is used, charge injection readily occurs from the areas of different type metal to the photosensitive layer, but the presence of the undercoat layer prevents said charge injection.

In the embodiments depicted in FIGS. 2 and 3, it is possible to use either a conductive substrate or a non-conductive substrate as the substrate of the photosensitive member. In this construction, the resistivity of the substrate itself is controllable to a desired value by adjusting the conductive layer to a suitable resistivity, thereby stabilizing the electrostatic characteristics. Furthermore, it is possible to similarly use the aforesaid undercoat layer used to cover the aforesaid substrate as a conductive layer for a conductive substrate containing different types of metals, such as substrate having surface irregularities or slight defects.

Furthermore, in the embodiments of FIGS. 2 and 3, a photosensitive member can be provided, which is usable in backside exposure methods, by providing the aforesaid dispersion layer as a conductive layer on a non-conductive substrate, such as glass or the like, to provide said substrate with conductivity.

Examples of useful substrates include conductive foil or plate of copper, aluminum, iron, nickel and the like in a sheet-like or drum-like configuration. The aforesaid metals may be spread or vacuum deposited on paper or resin film in the same manner as a layer of conductive compound such as indium oxide, tin oxide, conductive polymer or the like, or vacuum deposition or electroless plating on resin film or the like. A member imparted conductivity by forming a conductive layer according to the present invention, as previously described, on the surface of a material, which lacks conductivity such as insulated resin film paper and the like, may be used as the substrate of the present invention.

A cylindrical aluminum or aluminum alloy member is generally used as a substrate. Specifically, usable substrates include: machined tube formed of aluminum pipe that is extruded, drawn, and cut, and the exterior surface that is machined to about 0.2 to about 0.3 mm using a machine tool, such as a diamond bite or the like; DI tube formed of aluminum disc that is squeezed into a cap-like shape, and the exterior surface that is ironed; EI tube formed of aluminum disc that is impacted into a cap-like shape, and the exterior surface that is ironed; and ED tube that is formed of an extruded cold drawn member. These surfaces may be machined.

In the present invention, it is possible to use a substrate with a non-machined surface as the substrate of a photosensitive member by means of a construction that provides a predetermined undercoat layer or conductive layer between a substrate and a photosensitive layer, as previously described.

The thickness of the dispersion layer is different when constructed on a conductive substrate than when constructed on a high resistance substrate. Also, the thickness is different when only an undercoat layer or conductive layer is provided individually than when an undercoat layer and conductive layer are both provided. When the dispersion layer is too thin, the desired effectiveness of the dispersion layer is not obtained; whereas when the dispersion layer is too thick, the electrical resistance of the layer increases and causes a rise in residual potential with repeated use. In general, a thickness of about 0.1 to about 0.3 μm is desirable, about 1 to about 30 μm is preferable, and about 1 to about 20 μm is ideal. Layer thickness can be suitably selected for the various embodiments within these ranges.

The production of a photosensitive member according to the present invention is described hereinafter with reference to the photosensitive member shown in FIG. 1. In this case, tantalum-doped tin oxide powder is dispersed in a binder resin solution, as previously described, and the solution is applied to the surface of a conductive substrate, and dried to form a dispersion layer. It is desirable that after the application of the solution, drying is accomplished in a temperature range of about 60 to about 120° C. Any resin may be used to construct the dispersion layer insofar as said resin satisfies certain conditions such as strong bonding to the substrate, adequate solvent resistance, excellent powder dispersability, and the like. Examples of useful well known materials include: polyvinyl alcohol, polyvinyl methyl ether, polyvinyl imidazole, ethyl cellulose, ethylene-acrylate copolymer, casein, gelatin, polyamide and the like. Examples of typical useful resins include thermoplastic resins, such as polyester resins, acrylic resins, vinyl acetate resins, vinyl chloride-vinyl acetate resins, polyvinylbutyral resin, and the like, and thermoset resins, such as alkyd resins, melamine resins, urethane resins, epoxy resins, and phenolic resins. Among the aforesaid resins, the most desirable, from the perspective of adhesion characteristics and application characteristics, are polyester resins, acrylic melamine resins, and urethane resins.

Nonconductive white powder such as zinc oxide, calcium oxide, barium oxide, titanium oxide, silicon oxide, barium sulfate powder, calcium sulfate, barium carbonate, magnesium carbonate may be added to the dispersion layer, as necessary. The addition of nonconductive white powder to the dispersion layer can increase the light reflectivity of the layer and improve the sensitivity of the photosensitive layer.

Usable methods for applying the dispersion layer on the substrate include coating methods, such as dip coating, spray coating, spinner coating, wire bar coating, braid coating, roller coating, and curtain coating methods.

A charge generating layer may be provided over the dispersion layer, formed in the manner described above, by vacuum deposition of a charge generating material, application of a charge generating material dissolved in a medium such as amine or the like, or if it is necessary to dissolve a pigment in a suitable solvent, said pigment, the charge generating material, may be dispersed in a solution of dissolved binder resin, and drying the application fluid to form the charge generating layer. Then, a charge transporting layer may be formed over the charge generating layer by applying and drying an fluid application containing charge transporting material and binder resin.

In this way, the photosensitive member according to the embodiment shown in FIG. 1 is produced.

Although the photosensitive member has been specifically described in terms of sequential laminations of a charge generating layer and a charge transporting layer as a photosensitive layer superimposed over a dispersion layer, according to the present invention, the photosensitive layer may also comprise sequential laminations of a charge transporting layer and a charge generating layer. Organic photoconductive materials, such as polyvinyl carbazole, anthracene, phthalocyanines and the like, may be applied directly or mixed with an insulating binder resin to form a monolayer construction.

The photosensitive member of the present invention may be provided with a protective overcoat layer on the photosensitive layer. Examples of useful materials for a protective overcoat layer include polymers, such as acrylic resins, polyarylresins, polycarbonate resins, urethane resins and the like, used directly, or dispersions of low resistance compounds such as tin oxide indium oxide and the like. Organic plasma polymer film may be used as a protective overcoat layer. The plasma polymer film may contain oxygen, nitrogen, halogen, group III, and group V atoms of the periodic table of the elements.

Examples of useful organic materials, as the charge generating material used in the photosensitive member of the present invention, include: bisazo pigment, triarylmethane dye, thiazine dye, oxazine dye, xanthene dye, cyanine pigment, styryl pigment, pirilium dye, azo dye, qunacridone dye, indigo pigment, perylene pigment, polycyclic quinone pigment, bisbenzimidazole pigment, indathrone pigment, pigment, phthalocyanine pigment, and the like. Any materials may be used insofar as said materials generate charge carriers and are extremely efficient in light absorption.

Examples of useful charge transporting materials, for use in the photosensitive member, include: various colors of hydrazone compound, pyrazoline compound, styryl compound, triphenylmethane compound, oxadiazole compound, carbazole compound, stilbene compound, enamine compound, oxazole compound, triphenylamine compound, tetraphenylbenzidine compound, and azine compound. The binder resin, used to construct the photosensitive member, has electrical insularity, and, desirably, has a volume resistivity of about $1\times10^{12}$ Ω·cm or more, measured individually. Examples of useful binder materials include: the plastic resins, thermoset acrylic resins, photoset resins, photoconductive resins, and the like. Specific examples of useful materials include: thermoplastic resins, such as saturated polyester resins, polyamide resins, acrylic resins, ethylene-vinyl acetate resins, ion crosslinked olefin copolymer (ionomer), styrene-butadiene block copolymers, polycarbonate, vinyl chloride-vinyl acetate copolymers, cellulose esters, polyimide, styrol resins; thermoset resins, such as epoxy resins, urethane resins, silicone resins, phenolic resins, melamine resins, xylene resins, alkyd resins; thermoset acrylic resins, such as epoxy resins, urethane resins, silicone resins, phenolic resins, melamine resins, xylene resins, alkyd resins, thermoset acrylic resins, photoset resins; and photoconductive resins, such as polyvinyl carbazole, polyvinylpyrene, polyvinylanthracene, polyvinyl pyrrole, and the like. These binder resins may be used individually or in combinations of two or more.

When the charge transporting material is a high molecular weight charge transporting material, which uses itself as a binder resin, other binder resin need not be used.

The photosensitive member of the present invention may use: sensitizers with the binder resin, such as plasticizers like halogenated paraffin, vinylphenyl chloride, dimethylnaphthalene, dibutyl phthalate, O-terphenyl and the like; electron attracting sensitizers, such as chloranil, tetracyanoethylene, 2,4,7-trinitrofluorenone, 5,6-dicyanobenzoquinone, tetracyanoquinodimethane, tetrachlorophthalic anhydride, 3,5-dinitrobenzoic acid and the like; and sensitizers, such as methyl violet, rhodamine B, cyanine dye, beryllium salt, thiaberyllium salt and the like.

The aspect of the present invention, which is related to the dispersion layer formed between a substrate and a photosensitive layer, is described in detail hereinafter by way of specific examples.

EXAMPLE 1

10 parts-by-weight (hereinafter pbw) thermoplastic acrylic resin (Acrylic A405; Dainippon Ink, Ltd.), 10 pbw tantalum-doped tin oxide powder (SnO2; type VI; Mitsui Mining and Smelting Co., Ltd.), and 2 pbw melamine resin (Super Bekamine J820; Dainippon Ink, Ltd.) were dispersed in 100 pbw toluene.

The dispersion fluid was applied to the surface of a 30 mm diameter aluminum drum (surface roughness Rt=3 μm), and dried for 30 min at 150° C. to form a conductive layer (volume resistivity: $8.2\times10^{4}$ Ω·cm) 15 μm in thickness. The surface roughness Rt of the obtained conductive layer was 0.1 μm.

A solution comprising 5 pbw N-alkoxymethylnylon resin dissolved in a medium of 5 pbw methanol and 50 pbw n-butanol was applied to the surface of the aforesaid conductive layer to form an undercoat layer (volume resistivity: $7.8\times10^{9}$ Ω·cm) 1.0 Ωm in thickness. Then, 1 pbw c-type nonmetallic phthalocyanine, 1.0 pbw polyvinylbutyrol, and 100 pbw tetrahydrofuran (THF) were dispersed using a sand mill. The obtained phthalocyanine dispersion fluid was applied on the surface of the aforesaid undercoat layer and dried to form a charge generating layer 0.2 μm in thickness.

Structural Formula 1

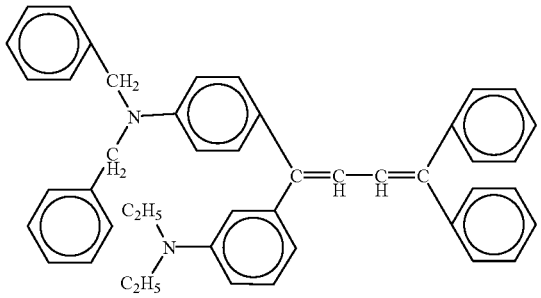

A fluid application comprising 10 pbw butadiene compound, 10 pbw polycarbonate resin (Panlite K1300; Teijin Kasei K.K.), and 180 pbw dichloromethane expressed by the above Structural Formula 1 was applied to the surface of the charge generating layer, and dried to form a charge transport layer 25 μm in thickness. Thus, a laminate type photosensitive member was produced.

EXAMPLE 2

100 pbw tantalum-doped tin oxide powder type VI; Mitsui Mining and Smelting co., Ltd.), 80 pbw polyurethane (Tesmodule 800; Japan Polyurethane. Ltd.), 80 pbw toluene, 80 pbw xylene, and 65 pbw ethyl acetate were dispersed for 3 hr in a paint shaker, then 10 pbw isocyanate (N-75; Sumitomo Chemical Co., Ltd.) was added to obtain a fluid application. This fluid application was applied to a glass cylinder, and heated at 120° C. for 10 min to dry to form a conductive layer 2 μm in thickness, with a volume resistivity of $7\times10^4$ Ω·cm, and 86% light transmittance.

A solution of 5 pbw N-alkoxymethylnylon resin dissolved in a medium of 5 pbw methanol\ and 50 pbw n-butanol was applied to the surface of the aforesaid conductive layer to form an undercoat layer (volume resistivity: $7.8\times10^9$ Ω·cm) 1.0 μm in thickness.

Then, 1 pbw T-type nonmetallic phthalocyanine, 1.0 pbw polyvinylbutyrol, and 100 pbw tetrahydrofuran (THF) were dispersed using a sand mill. The obtained phthalocyanine dispersion fluid was applied on the surface of the aforesaid undercoat layer and dried to form a charge generating layer 0.2 μm in thickness.

Structural Formula 2

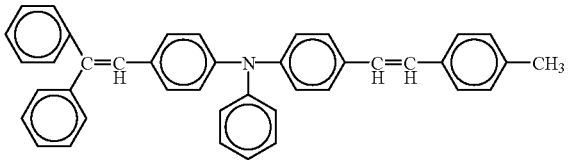

An fluid application comprising 10 pbw styryl compound, 12 pbw polycarbonate resin (Panlite C-Z; Teijin Kasei K.K.), and 180 pbw dichloromethane expressed by the above Structural Formula 2 was applied to the surface of the charge generating layer, and dried to form a charge transporting layer 25 μm in thickness. Thus, a laminate type photosensitive member was produced.

EXAMPLE 3

2 pbw tantalum-doped tin oxide powder type VI; Mitsui Mining and Smelting Co., Ltd.) were added to a solution comprising 0.2 pbw silane coupling agent ($C_5F_{11}CO_2(CH_2)_3Si(OCH_3)_3$) and 30 pbw methanol and the materials were mixed. The contents were extracted, and dried for 1 hr at 110° C. The powder coupling process was thus accomplished.

2 pbw tantalum-doped tin oxide powder obtained by the coupling process and 12 pbw polyamide resin (CM-8000; Toray, Ltd.) were dispersed in 100 pbw methanol.

The obtained dispersion fluid was applied to the surface of a 30 mm diameter aluminum drum (surface roughness Rt=0.7 μm), and dried for 30 min at 80° C. to form an undercoat layer (volume resistivity: $4\times10^{11}$ Ω·cm) 1.5 μm in thickness.

Then, 1 pbw T-type nonmetallic phthalocyanine, 1.0 pbw polyvinylbutyrol, and 100 pbw tetrahydrofuran (THF) were dispersed using a sand mill. The obtained phthalccyanine dispersion fluid was applied on the surface of the aforesaid undercoat layer and dried to form a charge generating layer 0.2 μm in thickness.

Structural Formula 3

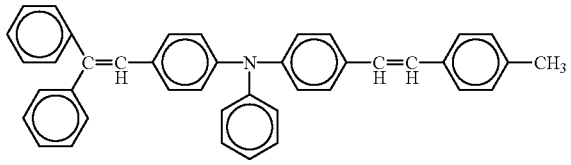

An fluid application comprising 10 pbw distyryl compound, 12 pbw polycarbonate resin (Panlite C-Z; Teijin Kasei K.K.), and 180 pbw tetrahydrosilane expressed by the above Structural Formula 3 was applied to the surface of the charge generating layer, and dried to form a charge transporting layer 25 μm in thickness. Thus, a laminate type photosensitive member was produced.

REFERENCE EXAMPLE 1

A photosensitive member was produced in exactly the same way as Example 1 with the exception that the conductive layer and undercoat layer of Example 1 were not provided.

REFERENCE EXAMPLE 2

A photosensitive member was produced in exactly the same way as Example 1 with the exception that carbon black was substituted for the tantalum-doped tin oxide powder used in the conductive layer in Example 1.

EXAMPLE 4

18 pbw thermoset phenol resin (PL-2205; Gunei-Kagaku-Sya), and 10 pbw tantalum-doped tin oxide powder ($SnO_2$; Pastran type VI; Mitsui mining and Smelting Co., Ltd.) were dispersed in 30 pbw isopropyl alcohol.

The dispersion fluid was applied to the surface of a 30 mm diameter aluminum drum (surface roughness Rt=3 μm), and dried for 30 min at 150° C. to form a conductive layer (volume resistivity: $2.5\times10^4$ Ω·cm) 10 μm in thickness. The surface roughness Rt of the obtained conductive layer was 0.1 μm.

A solution comprising 5 pbw N-alkoxymethylnylon resin dissolved in a medium of 5 pbw methanol and 50 pbw n-butanol was applied to the surface of the aforesaid conductive layer to form an undercoat layer (volume resistivity: $7.8\times10^9$ Ω·cm) 1.0 μm in thickness.

Then, 1 pbw χ-type nonmetallic phthalocyanine, 1.0 pbw polyvinylbutyrol, and 100 pbw tetrahydrofuran (THF) were dispersed using a sand mill. The obtained phthalocyanine dispersion fluid was applied on the surface of the aforesaid undercoat layer and dried to form a change generating layer 0.2 μm in thickness.

Structural Formula 4

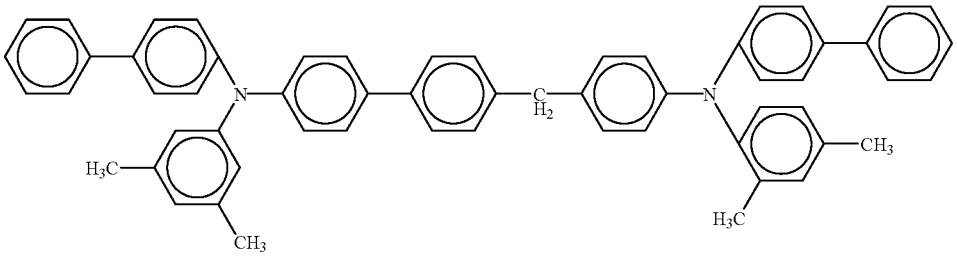

A fluid application comprising 10 pbw compound expressed by the above Structural Formula 4, 10 pbw polycarbonate resin (Panlite K1300; Teijin Kasei K.K.), and 100 pbw dichlorometbane was applied to the surface of the charge generating layer, and dried to form a charge transport layer 20 μm in thickness. Thus, a laminate type photosensitive member was produced.

EXAMPLE 5

100 pbw tantalum-doped tin oxide powder Pastran type VI; Mitsui mining and Smelting Co., Ltd.), 180 pbw phenol resin (L-2211; Gunei-Kagaku-Sya), 80 pbw toluene, and 65 pbw isopropyl alcohol 500 were dispersed for 3 hr in a paint shaker to obtain a fluid application. This fluid application was applied to a glass cylinder, and heated at 180° C. for 10 min to dry to form a conductive layer 2 mm in thickness, with a volume resistivity of $3.5\times10^4$ Ω·cm, and 85% light transmittance.

A solution of 5 pbw N-alkoxyniethylnylon resin dissolved in a medium of 5 pbw nwthanol and 50 pbw n-butanol was applied to the surface of the aforesaid conductive layer to form an undercoat layer (volume resistivity: $7.8\times10^9$ Ω·cm) 1.0 μm in thickness.

Then, 1 pbw χ-type nonmetallic phthalocyanine (Dainippon Ink, Ltd.), 1.0 pbw polyvinylbutyrol, and 100 pbw tetrahydrofuran (THF) were dispersed using a sand mill. The obtained phthalocyanine dispersion fluid was applied on the surface of the aforesaid undercoat layer and dried to form a charge generating layer 0.2 μm in thickness.

A fluid application comprising 10 pbw compound expressed by the above Structural Formula 5, 12 pbw polycarbonate resin (Panlite TS-2050; Teijin Kasei K.K.), and 100 pbw tgtrahydrofuran was applied to the surface of the charge generating layer, and dried to form a charge transporting layer 20 μm in thickness. Thus, a lanate type photosensitive member was produced.

EXAMPLE 6

2 pbw tantalum-doped tin oxide powder (Pastran type VI; Mitsui mining and Smelting Co., Ltd.) were dispersed in a solution comprising 600 pbw phenol resin (G4663C; Notape Co. Ltd.).

The obtained dispersion fluid was applied to the surface of a 30 mm diameter aluminum drum (surface roughness Rt=0.7 μm), and dried for 15 min at 140° C. to form an undercoat layer (volume resistivity: $6\times10^6$ Ω·cm) 1.0 μm in thickness.

Then, 1 pbw χ-type nonmetallic phthalocyanine, 1.0 pbw polyvinylbutyrol, and 100 pbw tetrahydrofuran (THF) were dispersed using a sand mill. The obtained phthalocyanine dispersion fluid was applied on the surface of the aforesaid undercoat layer and dried to form a charge generating layer 0.2 μm in thickness.

Structural Formula 5

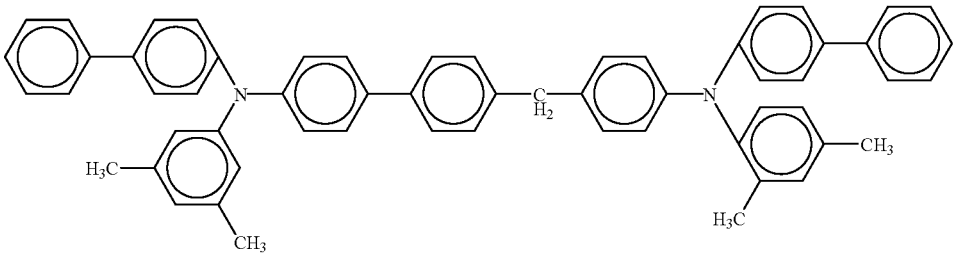

Structural Formula 6

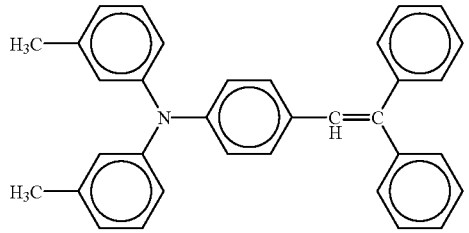

A fluid application comprising 10 pbw styryl compound expressed by the above Structural Formula 6, 12 pbw polycarbonate resin (Pamlite TS-2050; Teijin Kasel K.K.), and 100 pbw tetrahydrofuran was applied to the surface of the charge generating layer, and dried to form a charge transporting layer 20 μm in thickness. Thus, a laminate type photosensitive member was produced.

EXAMPLE 7

10 pbw thermoplastic acrylic resin (Acrylidic A405; Dainippon Ink, Ltd.), 10 pbw tantalum-doped tin oxide powder ($SnO_2$; type VI; Mitsui Mining and Smelting Co., Ltd.), and 2 pbw melamine resin (Super Beckamine J820; Dainippon Ink, Ltd.) were dispersed in 100 pbw toluene.

The dispersion fluid was applied to the surface of a 30 mm diameter aluminum drum (surface roughness Rt=3 μm), and dried for 30 min at 150° C. to form a conductive layer (volume resistivity: $8.2\times10^4$ Ω·cm) 15 μm in thickness. The surface roughness Rt of the obtained conductive layer was 0.1 μm.

A solution comprising 5 pbw N-alkoxymethylnylon resin dissolved in a medium of 5 pbw methanol and 50 pbw n-butanol was applied to the surface of the aforesaid conductive layer to form an undercoat layer (volume resistivity: $7.8\times10^9$ Ω·cm) 1.0 μm in thickness.

Then, 1 pbw fluorenone trisazo compound, 1.0 pbw polyvinylbutyral, and 100 pbw tetrahydrofuraln (THP) were dispersed using a sand mill. The obtained bisazo dispersion fluid was applied on the surface of the aforesaid undercoat layer and dried to form a charge generating layer 0.2 μm in thickness. The structural formula of the fluorenone trisazo compound is shown below.

Structural Formula 8

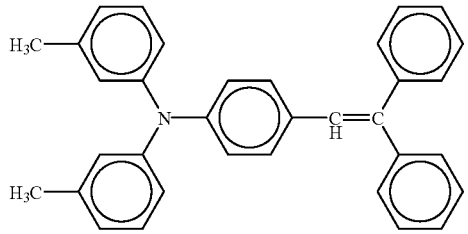

A fluid application comprising 10 pbw styryl compound expressed by Structural Formula 8 above, 10 pbw polycarbonate resin (Pamlite K1300; Teijin Kasei K.K.), and 180 pbw dichloromethane was applied to the surface of the charge generating layer, and dried to form a charge transport layer 25 μm in thickness. Thus, a laminate type photosensitive member was produced.

Each of the photosensitive members obtained in Examples 1 through 7 and Reference Examples 1 and 2 were installed in Minolta laser printer model SP101, the grid voltage was set at −750 V, and for each photosensitive member, the initial surface potential Vo (V), exposure quantity (hereinafter half decay exposure) E2/1 (erg/cm2) required to decay ½ of the initial surface potential, and decay rate DDR1 (%) of the initial potential when stored in the dark one second were measured. Measurement results are shown in Table 1.

Then, the photosensitive members were used for reverse developing, and the occurrence of black spots in the blank white areas of an image and the occurrence of white spots in a solid image were observed, and evaluated by the following criteria.

Evaluation results are shown in Table 1.

0: No black or white spots or only slight occurrence; no problem in practice.

X: black and white spots observed; member unsuitable for practical use.

XX: Extreme occurrence of black and white spots.

Structural Formula 7

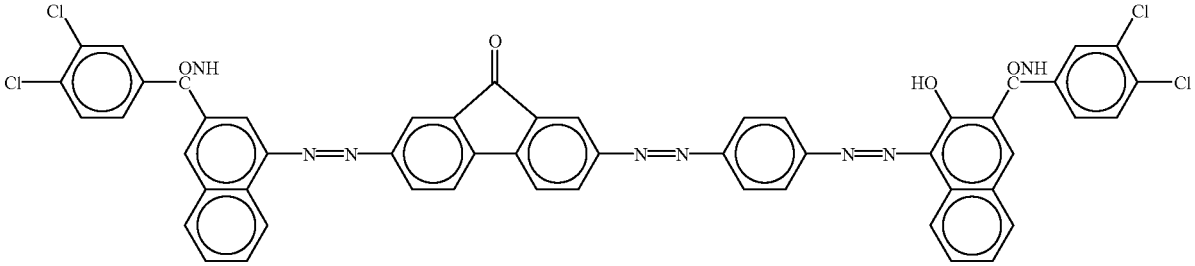

TABLE 1

| | $V_0$ (V) | $E_{1/2}$ (erg/cm$^3$) | $DDR_1$ (%) | BK spots |
|---|---|---|---|---|
| Ex 1 | −750 | 2.6 | 3.1 | ± |
| Ex 2 | −730 | 2.5 | 3.0 | ± |
| Ex 3 | −750 | 2.6 | 3.1 | ± |
| Ref 1 | −710 | 2.5 | 2.9 | XX |
| Ref 2 | −650 | 2.2 | 6.0 | XX |
| Ex. 4 | −740 | 2.7 | 2.8 | ○ |
| Ex. 5 | −760 | 2.7 | 3.0 | ○ |
| Ex. 6 | −750 | 2.9 | 3.3 | ○ |
| Ex. 7 | −730 | 0.72 (luxsec) | 2.3 | ○ |

The photosensitive member of the present invention provides excellent initial surface potential characteristics, and does not produce image noise such as residual potential elevation, black spots, or white spots.

Dispersion Layer as Protective Layer for Photosensitive Layer

An object of the present invention also is to provide a novel layer comprising tantalum-doped tin oxide powder having excellent stability and nontoxicity as conductive particles dispersed in resin as a protective overcoat layer of a photosensitive member.

A further object of the present invention is to provide a photosensitive member with excellent photosensitive member characteristics such as photosensitivity and the like, which is capable of forming superior images without fogging or producing unsharp images, and which has excellent repetition characteristics and durability.

Hence, the present invention also relates to a photosensitive member with a protective overcoat layer comprising a dispersion layer containing tantalum-doped tin oxide powder dispersed in resin.

The tantalum-doped tin oxide ($SnO_2$) used in the present invention is a tin oxide doped with about 0.1 to about 10 percent-by-weight tantalum metal. The doping may be accomplished by forming a solid solution of tin oxide and tantalum, or coating the surface of the tin oxide with tantalum. Doping may also be accomplished by fusing the tantalum to the tin oxide.

In the present invention, after the tin oxide is doped with tantalum, a silane coupling agent or titanium coupling agent is used for surface processing for even more improvement of the dispersability of the application fluid so as to form a uniform application layer. Moisture resistance is also improved more by the coupling process.

The tantalum-doped tin oxide used has a mean particle size of less than about 2 μm, and preferably less than about 1 μm, and ideally about 0.3 to about 1.0 μm. When the particle size is too large, cleaning characteristics are reduced due to toner abrasion. When particle size is too small, it becomes difficult to achieve uniform dispersion of the particles within the layer, leading to inadequate cleaning.

The content of tantalum-doped tin oxide in the dispersion layer is about 5 to about 70 percent-by-weight, and preferably about 7 to about 40 percent-by-weight, of the total dispersion layer. When the content is too small, the wear resistance and injury resistance are inadequately realized, and the residual potential of the photosensitive member is elevated. When the content is too large, minute irregularities occur in the surface of the protective overcoat layer after formation of the layer, which reduces the cleaning characteristics and produces toner abrasion. Furthermore, photosensitive characteristics are adversely affected due to reduced light transmittance. Also, the mechanical strength is reduced.

Examples of the form of the photosensitive member having a protective layer according to the present invention described above are shown in FIGS. 4 and 5.

Figure 4:
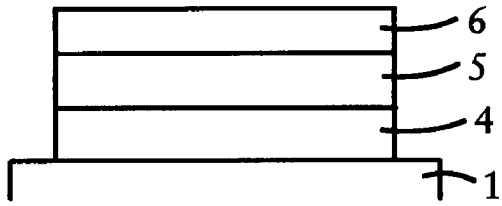
FIG. 4 is a section view of a photosensitive member according to a fourth embodiment of the present invention.

FIG. 4 shows a photosensitive member formed by sequentially superimposing on a substrate 1 a charge transporting layer 5 superimposed over a charge generating layer 4 as a laminite type photosensitive layer. The photosensitive layer is formed beneath a dispersion layer 6.

Figure 5:
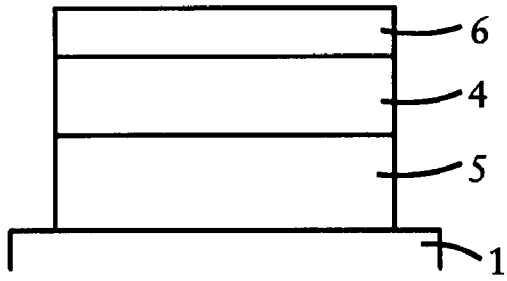
FIG. 5 is a section view of a photosensitive member according to a fifth embodiment of the present invention.

FIG. 5 shows a photosensitive member formed by sequentially superimposing on a substrate 1 a charge generating layer 4 over a charge transporting layer 5 as a so-called reverse laminite type photosensitive layer. The photosensitive layer is formed beneath a dispersion layer 6.

A photosensitive layer is formed beneath the dispersion layer. The photosensitive layer may be constructed of suitably selected well known materials such as charge generating materials, charge transporting materials, binder resins, and the like. The photosensitive layer may be a laminate type photosensitive layer, as show in FIGS. 4 and 5, or may be a so-called monolayer construction photosensitive layer having a combined charge generating layer and charge transporting layer (not shown).

The photosensitive layer is not limited to organic photosensitive layers, inasmuch as inorganic materials may be used, e.g., zinc oxide, cadmium sulfide, selenium alloy, amorphous silicone alloy, and the like.

The photosensitive member of the present invention is described hereinafter in terms of the embodiment depicted in FIG. 5 of sequential laminations on a substrate 1 of a charge generating layer 4, charge transporting layer 5, and dispersion layer 6 according to the present invention.

Examples of useful substrates include conductive foil or plate of copper, aluminum, iron, nickel and the like in a sheet-like or drum-like configuration. The aforesaid metals may be spread or vacuum deposited on paper or resin film in the same manner as a layer of conductive compound, such as indium oxide, tin oxide, conductive polymer or the like, or vacuum deposition or electroless plating on resin film or the like.

A charge generating layer 4 is formed over the aforesaid substrate 1. The charge generating layer 4 may be formed by vacuum deposition of charge generating material, application of charge generating material in a suitable solvent, or application and drying of a fluid application produced by dispersion of pigment in a suitable solvent, or, if necessary, in a solution of dissolved resin, and applying and drying over this charge generating layer 4, a solution containing charge transporting material and binder resin to form a charge transporting layer 5.

Examples of useful organic materials, as the charge generating material used in the photosensitive member of the present invention, include: bisazo pigment, triarylmethane dye, thiazine dye, oxazine dye, xanthene dye, cyanine pigment, styryl pigment, pirilium dye, azo dye, quinacridone dye, indigo pigment, perylene pigment, polycyclic quinone pigment, bisbenzimidazole pigment, indathrone pigment, squalium pigment, phthalocyanine pigment and the like. Any materials may be used insofar as said materials generate charge carriers and are extremely efficient in light absorption.

Examples of useful charge transporting materials, for use in the photosensitive member, include: various colors of hydrazone compound, pyrazoline compound, styryl compound, triphenylmethane compound, oxadiazole compound, carbazole compound, stilbene compound, enamine compound, oxazole compound, triphenylamine compound, tetraphenylbenzidine compound, azine compound. and the like.

The binder resin used to construct the photosensitive member has electrical insularity, and desirably has a volume resistivity of about $1\times10^{12}$ Ω·cm or more, measured individually. Examples of useful binder materials include the plastic resins, thermoset acrylic resins, photoset resins, photoconductive resins and the like. Specific examples of useful materials include thermoplastic resins, such as saturated polyester resins, polyamide resins, acrylic resins, ethylene-vinyl acetate resins, ion crosslinked olefin copolymer (ionomer), styrene-butadiene block copolymers, polycarbonate, vinyl chloride-vinyl acetate copolymers, cellulose esters, polyimide, styrol resins, thermoset resins such as epoxy resins, urethane resins, silicone resins, phenolic resins, melamine resins, xylene resins, alkyd resins, thermoset acrylic resins such as epoxy resins, urethane resins, silicone resins, phenolic resins, melamine resins, xylene resins, alkyd resins, thermoset acrylic resins, photoset resins, and photoconductive resins such as polyvinyl carbazole, polyvinylpyrene, polyvinylanthracene, polyvinyl pyrrole and the like. These binder resins may be used individually or in combinations of two or more.

When the charge transporting material is a high molecular weight charge transporting material, which is itself used as a binder resin, other binder resin need not be used.

The photosensitive member of the present invention may use: sensitizers with the binder resin, such as plasticizers like halogenated paraffin, vinylphenyl chloride, dimethylnaphthalene, dibutyl phthalate, O-terphenyl and the like; electron attracting sensitizers, such as chloranil, tetracyanoethylene, 2,4,7-trinitrofluorenone, 5,6dicyanobenzoquinone, tetracyanoquinodimethane, tetrachlorophthalic anhydride, 3,5-dinitrobenzoic acid and the like; and sensitizers, such as methyl violet, rhodamine B, cyanine dye, beryllium salt, thiaberyllium salt and the like.

The dispersion layer 6 of the most exterior surface of the photosensitive member may be: a dispersion layer formed by dispersing tantalum-doped tin oxide powder in a resin solution described later; applying this solution over a charge generating layer; and then drying the fluid application to form the dispersion layer. After the fluid application, it is desirable to dry the application within a temperature range of about 60 to about 120° C.

Any resin may be used to construct the dispersion layer insofar as said resin satisfies certain conditions, such as strong bonding to the substrate, adequate solvent resistance, excellent powder dispersability and the like. Examples of useful well known materials include polyvinyl alcohol, polyvinyl methyl ether, poly-N-vinyl imidazole, ethyl cellulose, ethylene-acrylate copolymer, casein, gelatin, polyamide and the like. Examples of typical useful resins include: thermoplastic resins, such as polyester resins, acrylic resins, vinyl acetate resins, vinyl chloride-vinyl acetate resins, polyvinylbutyral resin and the like; and thermoset resins such as alkyd resins, melamine resins, urethane resins, epoxy resins, phenolic resins and the like. Among the aforesaid resins, the most desirable from the perspective of adhesion characteristics and application characteristics are polyester resins, acrylic melamine resins, urethane resins.

Usable methods for applying the dispersion layer on the substrate include coating methods such as dip coating, spray coating, spinner coating, wire bar coating, braid coating, roller coating, and curtain coating methods.

The thickness of the dispersion layer is desirably less than about 7 μm, and preferably about 1 to about 5 μm. The dispersion layer of the present invention may be formed relatively thick, so as to improve the durability of the photosensitive member.

Although the photosensitive member has been described in terms of sequentially forming on a substrate a charge generating layer, charge transporting layer, and dispersion layer of the present invention, other constructions of the photosensitive member can be similarly applicable, and suitable modifications can be made by combining individual configurations of photosensitive members.

Since the dispersion layer can be formed relatively thick as described above, the present invention is most effective on a photosensitive member, wherein said dispersion layer is formed on an organic photosensitive layer, particularly from the perspective of improved durability.

The photosensitive member of the present invention may be provided with an undercoat layer beneath the photosensitive layer to improve adhesion characteristics. Materials useful for the undercoat layer include resins such as ultraviolet-curing resins, cold-setting resins, thermosetting resins and the like, vacuum deposition thin layer materials for forming thin layers of mixed resins having a dispersion of resistance controlling materials in said resin, metal oxides, and metal sulfides via vacuum deposition, ionplating and like methods, and amorphous carbon layer and amorphous silicone carbide layer produced by plasma polymerization and the like.

EXAMPLE 1

1 pbw [illegible]-type nonmetallic phthalocyanine, 0.5 pbw polyvinylbutyrol, and 50 pbw tetrahydrofuran (THF) were dispersed using a sand mill. The obtained phthalocyanine dispersion fluid was applied on the surface of an aluminum drum and dried to form a charge generating layer 0.3 μm in thickness.

Structural Formula 9

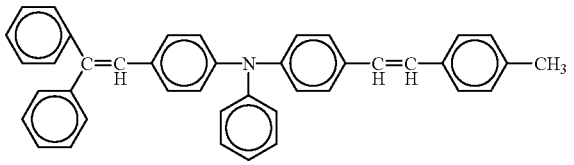

A fluid application comprising a dispersion of 10 pbw distyryl compound, 12 pbw polycarbonate resin (TS2020; Teijin Kasei K.K.), and 180 pbw tetrahydrofuran expressed by the above Structural Formula 9 was applied to the surface of the charge generating layer, and dried to form a charge transporting layer 22 μm in thickness.

A fluid application of a dispersion of 40 pbw tantalum-doped tin oxide powder ($SnO_2$) (Pastran type VI; Mitsui Mining and Smelting Co., Ltd.), and 70 pbw polyurethane resin solution (Letane 4000; Kansai Paint, Ltd.) was applied to the surface of the charge transporting layer 3 μm thick and dried to produce a photosensitive member.

EXAMPLE 2

1 pbw τ-type nonmetallic phthalocyanine, 0.5 pbw polyvinylbutyrol, and 50 pbw tetrahydrofuran (THF) were dispersed using a sand mill. The obtained phthalocyanine dispersion fluid was applied on the surface of an aluminum drum and dried to form a charge generating layer 0.3 μm in thickness.

Sturctural Formula 10

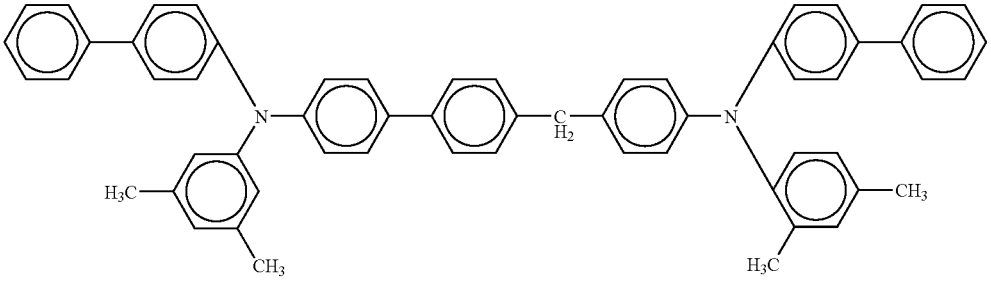

A fluid application comprising a dispersion of 10 pbw benzyldiphenyl compound, 10 pbw polycarbonate resin (Panlite K-1300; Teijin Kasei K.K.), and 180 pbw dichloromethane expressed by the above Structural Formula 10 was applied to the surface of the charge generating layer, and dried to form a charge transporting layer 25 μm in thickness.

A fluid application of a dispersion of 30 pbw tantalum-doped tin oxide powder ($SnO_2$) (Pastran type VI; Mitsui Mining and Smelting Co., Ltd.), and 60 pbw acrylic resin solution (G-4663A; No-tape Co. Ltd.) was applied to the surface of the charge transporting layer 3 μm thick and dried to produce a photosensitive member.

REFERENCE EXAMPLE 1

A photosensitive member was produced in exactly the same way as in Example 1 with the exception that tantalum-doped tin oxide was not contained in the protective overcoat layer.

REFERENCE EXAMPLE 2

A photosensitive member was produced in exactly the same way as in Example 2 with the exception that tin oxide that was not doped with tantalum was used in the protective overcoat layer.

Each of the photosensitive members obtained in Examples 1 and 2 and Reference Examples 1 and 2 were installed in Minolta laser printer model SP101, and used for a 5,000 copy print resistance test. The initial surface potential Vo (V) of the photosensitive member, exposure quantity (hereinafter half decay exposure) $E_{1/2}$ (erg/cm$^2$) required to decay ½ of the initial surface potential, and decay rate DDR1 (%) of the initial potential when stored in the dark 1 second were measured initially and after 5,000 printings. The produced images were visually examined and ranked as described below. The amount of shaving of the protective overcoat layer was measured after 5,000 printings, and ranked as described below.

Image Evaluation

0: No fog or unsharp images.

X: Light density, and some fog and unsharpness observed.

Layer Shaving

0: Amount shaved less than 1 μm.

X: Amount shaved 1 μm or more.

Measurement results are shown in Table 2 below.

| | E½ (erg/cm$^2$) | | Image | | Shaved amt | Vo (V) | | $DDR_1$ (%) | |
|---|---|---|---|---|---|---|---|---|---|
| | Initial | After 5000 | Initial | After 5000 | After 5000 | Initial | After 5000 | Initial | After 5000 |
| Ex 1 | 2.5 | 2.6 | 0 | 0 | 0 | −750 | −750 | 3.3 | 3.8 |
| Ex 2 | 2.7 | 2.9 | 0 | 0 | 0 | −760 | −750 | 3.6 | 3.8 |
| Ref 1 | 4.5 | 9.8 | X | X | X | −770 | −780 | 2.5 | 2.9 |
| Ref 2 | 3.1 | 5.6 | 0 | X | 0 | −760 | −770 | 3.1 | 4.3 |

The present invention provides a photosensitive member capable of maintaining stable photosensitive member characteristics such as sensitivity and the like with repeated use over a long period by incorporating tantalum-doped tin oxide powder in a protective overcoat layer of the photosensitive layer, and further provides excellent stability and durability.

Of course, it should be understood that a wide range of changes and modifications can be made to the preferred embodiments described above. It is therefore intended that it is the foregoing claims, including all equivalents, which are intended to define the scope of this invention.

What is claimed is:

1. A photosensitive member comprising:

a photosensitive layer; and an exterior surface layer containing tantalum doped tin oxide having the mean particle size of 0.3 to 1.0 micro-meters.

2. The photosensitive member of claim 1, wherein the tantalum doped tin-oxide is dispersed in a binder resin.

3. The photosensitive member of claim 1, wherein the tantalum doped tin oxide is a tin oxide doped with 0.1 to 10 percentage-by-weight tantalum.

4. The photosensitive member of claim 1, wherein the tantalum doped tin oxide is a solid solution of tin oxide and tantalum.

5. The photosensitive member of claim 1, wherein the tantalum doped tin oxide is formed by coating the surface of tin oxide with tantalum.

6. The photosensitive member of claim 1, wherein a content of the tantalum doped tin oxide is 5 to 70 percentage-by-weight of the total of the exterior surface layer.

7. The photosensitive member of claim 1, wherein the exterior surface layer has a thickness of 7 micro-meters or less.

8. The photosensitive member of claim 7, wherein the exterior surface layer has the thickness of 1 to 5 micro-meters.

9. The photosensitive member of claim 6, wherein the content of the tantalum doped tin oxide is 7 to 40 percentage-by-weight.

10. The photosensitive member of claim 1, wherein the tantalum doped tin oxide is surface-treated by a silane coupling agent or a titanium coupling agent.

11. A photosensitive member comprising:

a substrate;

a charge generating layer being formed on the substrate and containing an organic charge generating material;

a charge transporting layer being formed on the charge generating layer and containing a charge transporting material and a first binder resin; and an exterior surface layer being formed on the charge transporting layer and containing tantalum doped tin oxide having the mean particle size of 0.3 to 1.0 micro-meters and a second binder resin.

12. The photosensitive member of claim 11, wherein the tantalum doped tin oxide is a tin oxide doped with 0.1 to 10 percentage-by-weight tantalum.

13. The photosensitive member of claim 11, wherein a content of the tantalum doped tin oxide is 5 to 70 percentage-by-weight of the total of the exterior surface layer.

14. The photosensitive member of claim 13, wherein the content of the tantalum doped tin oxide is 7 to 40 percentage-by-weight.

15. The photosensitive member of claim 11, wherein the exterior surface layer has a thickness of 7 micro-meters or less.

16. The photosensitive member of claim 15, wherein the exterior surface layer has the thickness of 1 to 5 micro-meters.

17. The photosensitive member of claim 11, wherein the tantalum doped tin oxide is surface-treated by a silane coupling agent or a titanium coupling agent.

* * * * *